US006007193A

United States Patent [19]

Kashimura et al.

[11] Patent Number: 6,007,193

[45] Date of Patent: Dec. 28, 1999

[54] METHOD AND APPARATUS FOR REMOVING AIR BUBBLES FROM HOT MELT INK IN AN INK-JET PRINTER

[75] Inventors: Akira Kashimura; Norimass Kondo, both of Hitachinaka, Japan

[73] Assignee: Hitachi Koki Co., Ltd., Tokyo, Japan

[21] Appl. No.: 09/027,184

[22] Filed: Feb. 20, 1998

[30] Foreign Application Priority Data

Feb. 21, 1997 [JP] Japan ..... 9-036805

[51] Int. Cl.[6] ..... B41J 2/19

[52] U.S. Cl. ..... 347/92; 347/18; 400/120.08

[58] Field of Search ..... 347/88, 17, 18, 347/30, 85, 86, 87, 89, 92; 400/120.01, 120.08

[56] References Cited

U.S. PATENT DOCUMENTS

| | | | |
|---|---|---|---|
| 4,460,904 | 7/1984 | Oszczakiewicz et al. | 347/89 |
| 4,476,472 | 10/1984 | Aiba et al. | 347/89 |
| 4,502,055 | 2/1985 | Horike et al. | 347/92 |
| 4,814,786 | 3/1989 | Hoisington et al. | 347/89 |
| 4,929,963 | 5/1990 | Balazar | 347/89 |
| 4,937,598 | 6/1990 | Hine et al. | 347/89 |
| 5,105,209 | 4/1992 | Koto et al. | 347/88 |
| 5,291,215 | 3/1994 | Nozawa et al. | 347/18 |
| 5,341,162 | 8/1994 | Hermanson et al. | 347/92 |
| 5,489,925 | 2/1996 | Brooks et al. | 347/88 |
| 5,557,305 | 9/1996 | Hine et al. | 347/17 |

*Primary Examiner*—Eugene Eickholt
*Attorney, Agent, or Firm*—Whitham, Curtis & Whitham

[57] ABSTRACT

In the ink jet printer using hot melt ink, a heater is provided for overheating hot melt ink in the ink supply channel. The collector is provided for collecting air bubbles generated when the hot melt ink is overheated by the heater. The air bubbles, collected in the collector, are then expelled from the release valve. The hot melt ink is subsequently cooled before the ink enters the print head section, where the air is dissolved in the ink. The above-described air bubble-releasing and -dissolving processes are repeatedly performed as the ink is circulated due to the maintained difference in ink level between the ink supply chamber and the ink collecting chamber.

14 Claims, 3 Drawing Sheets

AIR DISSOLVING CAPACITY TO INK TEMPERATURE

INK TEMPERATURE IN INK PASSAGE

METHOD AND APPARATUS FOR REMOVING AIR BUBBLES FROM HOT MELT INK IN AN INK-JET PRINTER

BACKGROUND OF THE INVENTION

1. Field of the Invention

The present invention relates to an ink jet printer using hot melt ink, and more particularly to a method and apparatus for removing air bubbles from the hot melt ink.

2. Description of the Related Art

There has bean conventionally proposed an ink jet printer of a type for ejecting hot melt ink onto recording medium.

SUMMARY OF THE INVENTION

FIG. 1 shows a cross-sectional view of a conceivable on-demand type ink jet printer 50. The printer 50 is comprised of: an ink tank 60 storing therein hot melt ink I; and a manifold 55 provided in fluid communication with the ink tank 60. The manifold 55 has an ink channel 56 formed therein. The ink channel 56 is communicated with the ink tank 60 at its one open end. A plurality of nozzles 51 are formed through one side wall of the manifold 55 in fluid communication with the ink channel 56. The manifold 55 therefore serves to supply ink to the nozzles 51.

The manifold 55 Is further provided with a purging valve portion 70. The purging valve portion 70 includes an additional chamber 71 which is formed in the manifold 55 in fluid communication with the ink channel 56 via a small communication hole 72. A ball 57 is provided in the chamber 71. The ball 57 is purged against the small communication hole 72 by a compression spring 58. With this structure, the communication hole 72 is ordinarily closed with the ball 57. An ink ejection opening 59 is formed in the wall of the manifold 55 in fluid communication with the additional chamber 71.

The ink tank 60 in formed with an air through-hole 62. A heater 63 is provided for heating the ink tank 60. Another heater 64 is provided for heating the nozzles 51. The hot melt ink I is ink of a type that is melted into a liquid state when thermally heated. Both of the heaters 63 and 64 are therefore provided for heating the hot melt ink I to a specified temperature, thereby maintaining the ink I in the liquid state.

With the above-described structure, the manifold 55 is ordinarily filled with liquid-state ink I supplied from the ink tank 60. A recording medium is conveyed in confrontation with the nozzles 51. The nozzles 51 are selectively driven to eject ink I to the recording medium.

When a power source (not shown) of the heaters 63 and 64 is turned off, temperature of ink I drops, and the ink I condenses and hardens accordingly. When the ink I thus condenses into a solid state, the volume of the ink I is decreased, and accordingly a layer of air develops along the inner wall of the manifold 55.

When the power is again supplied to the heaters 63 and 64, ink I and the air layer located in the ink channel 56 is expanded, as a result of which some of the air and the ink within the manifold 55 is expelled from the nozzle openings 51. Ink I within the manifold 55 melts, and some of the air becomes dissolved again in the ink I. This process is called a "cold start."

After the cold start process, a large amount of air bubbles still remains in the manifold 55. In order to remove this residual air from the manifold 55, a purging process is performed. According to this purging process, pressurized air is introduced via the air hole 62 to the ink tank 60. As a result, ink is forced out through the purging valve 70. More specifically, ink forcibly flows through the manifold 55, and pushes the ball 57 against the urging force of the compression spring 58. As a result, the ball 57 moves apart from the communication hole 72. Through the thus opened communication hole 72, ink flows into the additional chamber 71, and then flows out through the ink ejection opening 59. Ink also flows out through the nozzle openings 51. The residual air is expelled together with the ink through the openings 51 and 59. Thus, the residual air is removed from within the manifold 55 during the purging process.

The above-described purging process is performed at every cold start process, that is, every time power is turned ON. The purging process is additionally performed repeatedly at a fixed time interval, while the ink jet printer 50 is operated, in order to remove air bubbles generated in the manifold 55 during the ink ejection operation.

The purging process is, however, uneconomical because a large amount of ink has to be ejected forcibly. The large amount of ink is therefore wasted each time the purging process is attained.

Some air bubbles adhere to depressions formed in the inner walls of the manifold 55. Those air bubbles do not move together with ink even when the large amount of ink is forced to flow within the manifold 55 toward the openings 51 and 59. Those air bubbles can be eliminated only when they are dissolved back to ink.

In view of the problems described above, it is an object of the present invention to provide an improved ink jet printer which is capable of sufficiently removing air bubbles from ink.

In order to attain the above and other objects, the present invention provides an ink jet printing apparatus, the apparatus comprising: an ink tank for collecting and storing hot melt ink; a print head for selectively ejecting hot melt ink to a printing medium to thereby print images on the printing medium; an ink circulatory path for supplying the print head with hot melt ink from the ink tank and for supplying the hot melt ink from the print head back to the ink tank, the ink circulatory path including: an ink supply channel communicated between the ink tank and the print head and provided with a heater for heating ink in the ink supply channel, thereby causing air dissolved in the hot melt ink to be converted into air bubbles: an air bubble collecting portion, provided to the ink supply channel, for collecting the air bubbles and for expelling air bubbles outside from the air bubble collecting portion; an cooling channel, communicated between the ink supply channel and the print head, for cooling the hot melt ink, thereby causing residual air bubbles to be dissolved in the hot melt ink; and an ink collecting channel communicated between the print head and the ink tank to supply hot melt ink back to the ink tank.

According to another aspect, the present invention provides a hot melt ink jet printing apparatus, the apparatus comprising: an ink tank having an ink supply chamber and an ink collecting chamber for storing hot melt ink: a print head for receiving hot melt ink and for selectively ejecting hot melt ink, thereby printing images, an ink supply channel, provided between the ink supply chamber and the print head, for supplying the hot melt ink to the print head, the ink supply channel being provided with an overheating heater for overheating the hot melt ink, thereby releasing air bubbles from the hot melt ink, an air bubble collector for collecting the air bubbles and for expelling the air bubbles outside, and an ink cooling unit for cooling the overheated hot melt ink, thereby causing residual air bubbles to be dissolved In the hot melt ink; an ink collecting channel, connected between the print hand and the ink collecting chamber, for supplying hot melt ink not ejected from the print head to the ink collecting chamber; and an ink bypass channel, connected between the ink supply chamber and the ink collecting chamber, the ink bypass channel being provided with a pump for supplying hot melt ink from the ink collecting chamber to the ink supply chamber to maintain that a level of hot melt ink in the ink supply chamber be higher than a level of hot melt ink in the ink collecting chamber, thereby achieving an ink circulatory flow through the ink supply chamber, the ink supply channel, the print head, the ink collecting channel, and the ink collecting chamber.

According to a further aspect, the present invention provides a method for removing air from ink in an ink jet printing apparatus, the method comprising the steps of: thermally heating hot melt ink to cause air dissolved in the hot melt ink to be converted into air bubbles; separating the air bubbles from the hot melt ink; thermally cooling the hot melt ink to cause residual air bubbles to be dissolved in the hot melt ink; supplying the hot melt ink to a print head to selectively eject the hot melt ink; and supplying hot melt ink, not ejected from the print head, to the heating step, thereby repeatedly performing the heating step, the air bubble separating step, the cooling step, and the ink supplying step.

According to still another aspect, the present invention provides a method of eliminating air bubbles from hot melt ink in an ink jet printing apparatus, the ink jet printing apparatus including an ink supply chamber, an ink supply channel connected to the ink supply chamber, an ink cooling channel connected to the ink supply channel, a print head connected to the ink cooling channel, an ink collecting channel connected to the print head, and an ink collecting chamber connected both to the ink collecting channel and the ink supply chamber, hot melt ink being circulating through the ink supply chamber, the ink supply channel, the ink cooling channel, the print head, the ink collecting channel, and the ink collecting chamber, the method comprising the steps of: overheating hot melt ink in the ink supply channel, thereby reducing an air dissolving capacity of the hot melt ink and causing air bubbles from being released from the hot melt ink; separating the air bubbles from the hot melt ink in the ink supply channel; and subsequently cooling the hot melt ink, in the ink cooling channel, to a specified temperature at which the hot melt ink does not solidify, thereby increasing the air dissolving capacity of the hot melt ink and causing residual air bubbles to be dissolved in the hot melt ink, to eliminate air bubbles in and around the print head.

DETAILED DESCRIPTION OF THE INVENTION

An ink jet printing apparatus according to the present invention will be described below.

According to the present invention, hot melt ink is circulated in the ink jet printing apparatus. The ink jet printing apparatus Is constructed from: an ink tank; a printing head; and an ink circulatory path. The ink circulatory path is provided for supplying the hot melt ink from the ink tank to the printing head and for supplying the hot melt ink from the printing head back to the ink tank. Because the hot melt ink is thus circulated through the circulatory path between the ink tank and the printing head, even when air bubbles are generated in the printing head, the air bubbles will not stay in the printing head. The continuously-flowing ink takes those a bubbles away from the printing head. Accordingly, those air bubbles will not affect undesirable effects on the print head. Similarly, even when air bubbles are generated in the circulatory path in the vicinity of the printing head, the air bubbles will not stay in the vicinity of the printing head. The air bubbles will not affect any undesirable effects on the printing heat. The printing head will therefore not perform printing operation with undesirable low quality.

According to the present invention, the hot melt ink is circulated in the ink jet printing apparatus while temperature of the hot melt ink is controlled. Air can be dissolved in the hot melt ink in a melted state. The air dissolving capacity of the hot melt ink changes according to the temperature. According to the present invention, therefore, while the hot melt is circulated in the ink jet printing apparatus, a temperature control is achieved to efficiently remove air from the ink. More specifically, the temperature of the hot melt ink is first increased excessively, thereby decreasing the air dissolving capacity of the hot melt ink. As a result, air bubbles release from the hot melt ink. The air bubbles are separated from the ink. Subsequently, the temperature of the ink is decreased to a temperature, at which the ink will not solidify. As a result, the air dissolving capacity of the ink is increased. Residual air bubbles, not separated from the ink and adhering to the apparatus walls are dissolved back into the ink. The hot melt ink, from which air bubbles are thus removed, is then supplied to the printing head.

The above-described temperature control is attained while the hot melt ink is circulated through the circulatory path. Accordingly, while the hot melt ink is circulated repeatedly, air is repeatedly removed from the hot melt ink.

An ink jet printer according to a preferred embodiment of the present invention will be described below with reference to the accompanying drawings.

Figure 1:
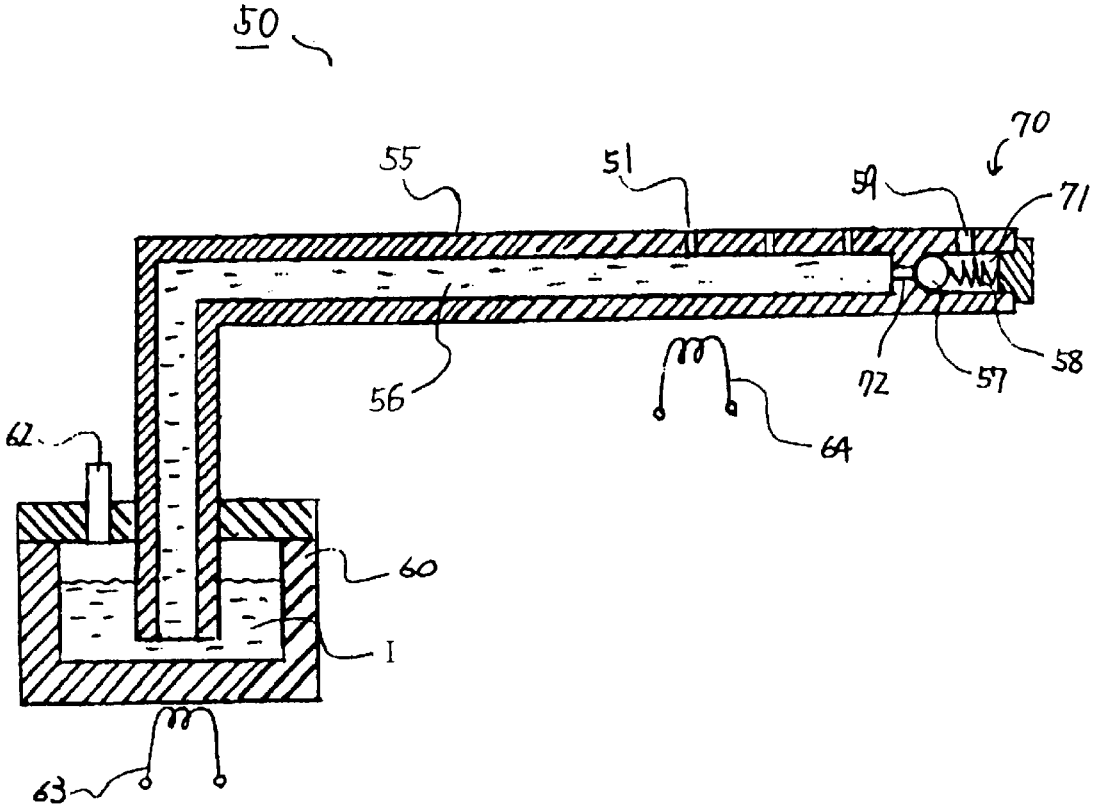
FIG. 1 is a cross-sectional view of a conceivable ink jet printer.
Figure 2:
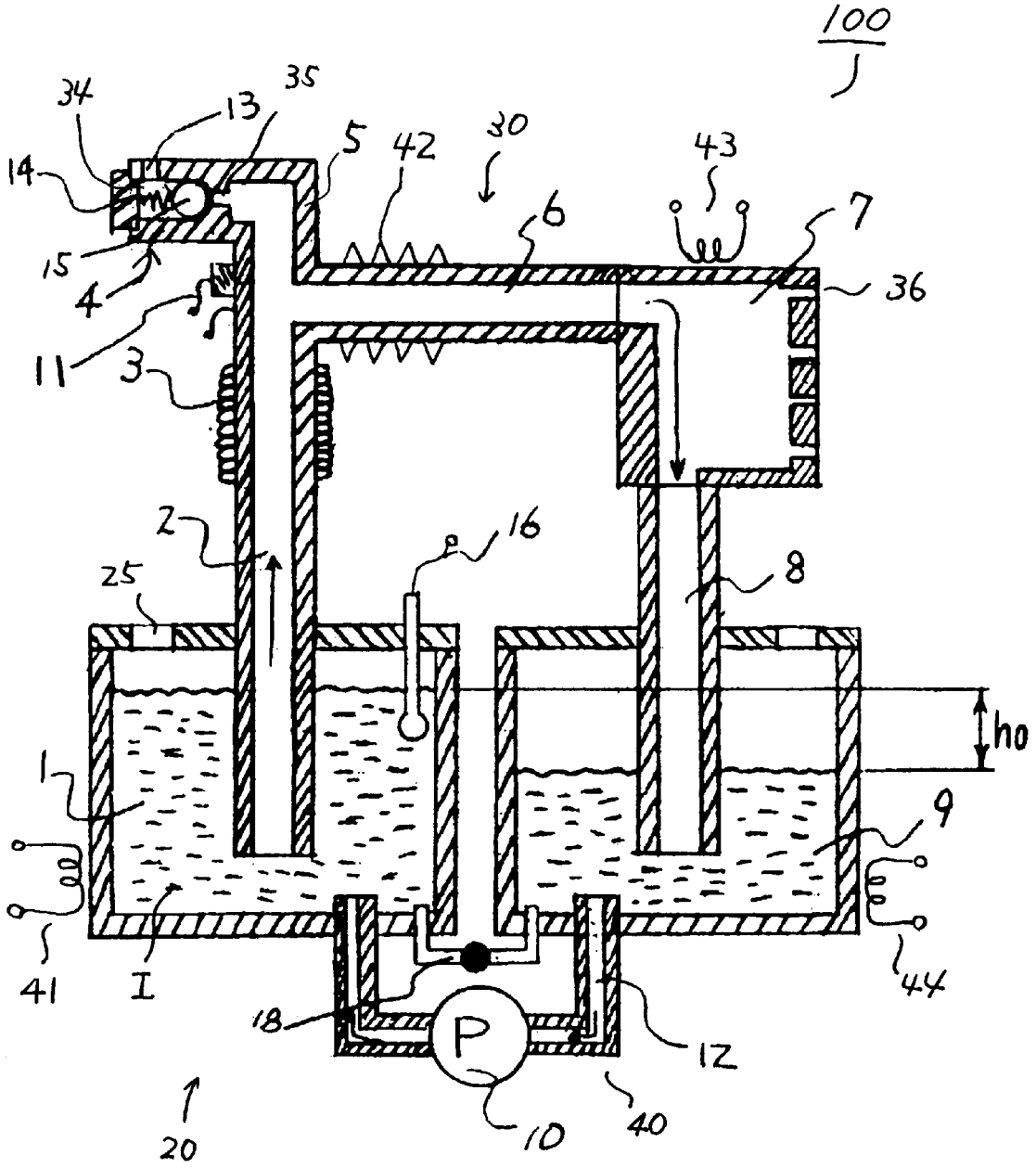
FIG. 2 is a cross-sectional view showing an ink jet printer of a preferred embodiment of the present invention.

As shown in FIG. 2, the ink jet printer 100 of the present embodiment mainly includes: an ink tank 20 storing hot melt ink I therein; and a manifold 30 provided in fluid communication with the ink tank 20. The ink tank 20 includes an ink supply chamber 1 and an ink collecting chamber 9. A bypass pipe 40 is provided between the ink supply chamber 1 and the ink collecting chamber 9.

The manifold 30 has an ink passage formed therein. The ink passage is comprised of: an ink supply channel 2 extending vertically upwardly from the ink supply chamber 1; an air bubble collecting chamber 5 extending upwardly from the top portion of the ink supply channel 2; an ink cooling path 6 extending horizontally from the top portion of the ink supply channel 2; a print head chamber 7 connected with the ink cooling path 6 and extending vertically downwardly; and an ink collecting channel 8 extending further downwardly from the print head chamber 7 toward the ink collecting chamber 9.

The manifold 30 is formed with a plurality of nozzles 36 in fluid communication with the print head chamber 7. The nozzles 36 are driven by a driving mechanism (not shown)

to selectively eject hot melt ink I supplied to the print head chamber 7. For example, each nozzle 36 may be driven to eject ink according to deformation of a piezoelectric element (not shown) provided to the nozzle 36.

The ink bypass pipe 40 has an ink bypass path 12 formed therein. The ink bypass path 12 is in fluid communication with both the ink collecting chamber 9 and the ink supply chamber 1.

It is noted that the hot melt ink I is contacted with air via the surface of the ink I in the ink supply chamber 1 and in the ink collecting chamber 9. The hot melt ink I is not contacted with air in the ink supply channel 2, the ink cooling path 6, the print head chamber 7, and the ink collecting chamber 5.

The ink supply chamber 1 is provided with an ink level sensor 16 for detecting the level of hot melt ink I stored in the ink supply chamber 1. A pressure differential sensor 18 is provided between the ink supply chamber 1 and the ink collecting chamber 9 to detect the difference between the levels of hot melt ink I in the ink supply chamber 1 and the ink collecting chamber 9. A pump 10 is provided to the ink bypass pipe 40 for feeding ink from the ink collecting chamber 9 to the ink supply chamber 1 through the ink bypass path 12. The pump 10 is controlled to maintain the ink level in the ink supply chamber 1 to be higher than the ink level in the ink collecting chamber 9 by a fixed amount "h0". It is noted that the total amount of hot melt ink I in the ink chambers 1 and 9 is set so that the lower tip end of the ink supply channel 2 is properly positioned lower than the ink level in the ink supply chamber 1 and so that the lower tip end of the ink collecting channel 8 is properly positioned lower than the ink level in the ink collecting chamber 9.

With this structure, hot melt ink I is circulated from the ink supply chamber 1 through the ink supply channel 2, the ink cooling path 6, the print head chamber 7, the ink collecting channel 8, the ink collecting chamber 9, the ink bypass path 12, and back to the ink supply chamber 1. Accordingly, even when some air bubbles are generated in the print head chamber 7, the continuingly-flowing ink I prevents those air bubbles from staying in the print head chamber 7. The continuingly-flowing ink I takes those air bubbles away from the print head chamber 7. Similarly, even when some air bubbles are generated in the ink cooling path 6, which is located in the upstream side of and near to the print head chamber 7, the continuingly-flowing ink will take the air bubbles away from the ink cooling path 6. It is therefore possible to prevent those air bubbles from staying in the print head chamber 7 and in the ink cooling section 6. It is possible to prevent those air bubbles from affecting undesirable effects on the ink ejection operation at the nozzles 36.

Figure 4:
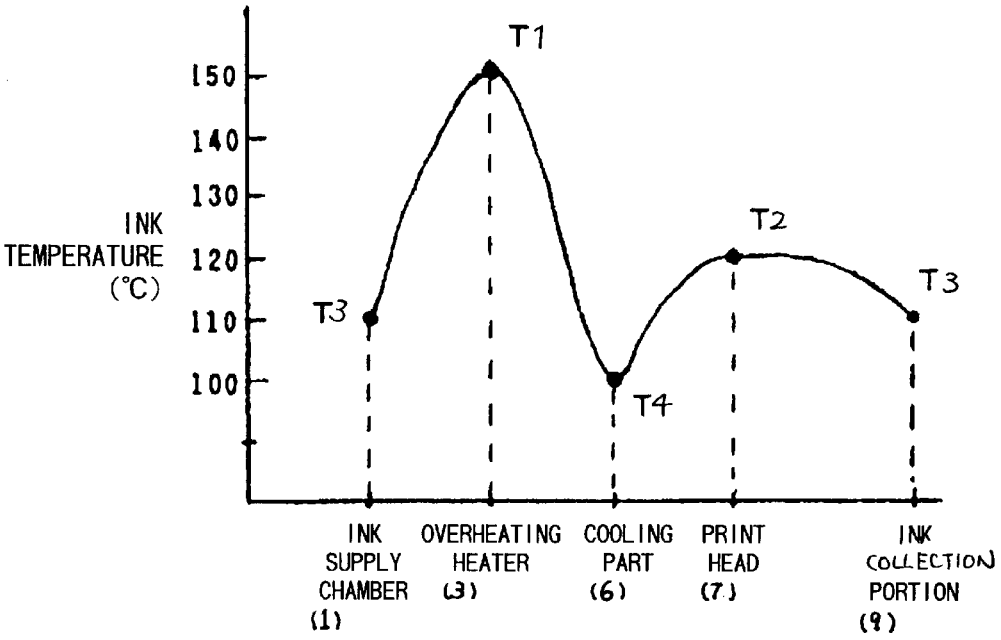
FIG. 4 is a graph showing temperatures set within the ink passage in the ink jet printer of FIG. 2.

Heaters 41 and 44 are provided to the ink supply chamber 1 and the ink collecting chamber 9, respectively. A heater 3 is provided around the ink supply channel 2. Another heater 43 is provided to the print head chamber 7. A heat radiation fin 42 is provided to the ink cooling path 6. As shown in FIG. 4, the heaters 41 and 44 are for beating the ink supply chamber 1 and the ink collecting chamber 9 to the temperature of 110° C. in order to maintain the hot melt ink I stored in the chambers 1 and 9 in a liquid state. The heater 3 is for heating the ink supply channel 2 to the temperature of 150° C. in order to excessively heat the hot melt ink I supplied to the ink supply channel 2. The heat radiation fin 42 is for controlling the ink cooling path 6 to the temperature of 100° C. in order to compulsively cool down the excessively-heated ink I, which is supplied to the ink cooling path 6 from the ink supply channel 2. It is noted that the hot melt ink I will not solidify at the temperature of 100° C. The heater 43 is for heating the print head chamber 7 to the temperature of 120° C. in order to adjust the viscosity of the hot melt ink I to be suitable for being ejected from the nozzles 36.

The ink supply chamber 1 is formed with an air through-hole 25. An air bubble release valve 4 is provided to the manifold 30 at a top end of the air bubble collecting chamber 5. The air bubble release valve 4 includes an additional chamber 34 which is formed in the manifold 30 in fluid communication with the air bubble collecting chamber 5 via a small communication hole 35. A ball 15 is provided in the chamber 34. The ball 15 is urged against the small communication hole 35 by a compression spring 14. With this structure, the communication hole 35 is ordinarily closed with the ball 15. An air outlet 13 is formed in the wall of the manifold 30 in fluid communication with the additional chamber 34.

Figure 3:
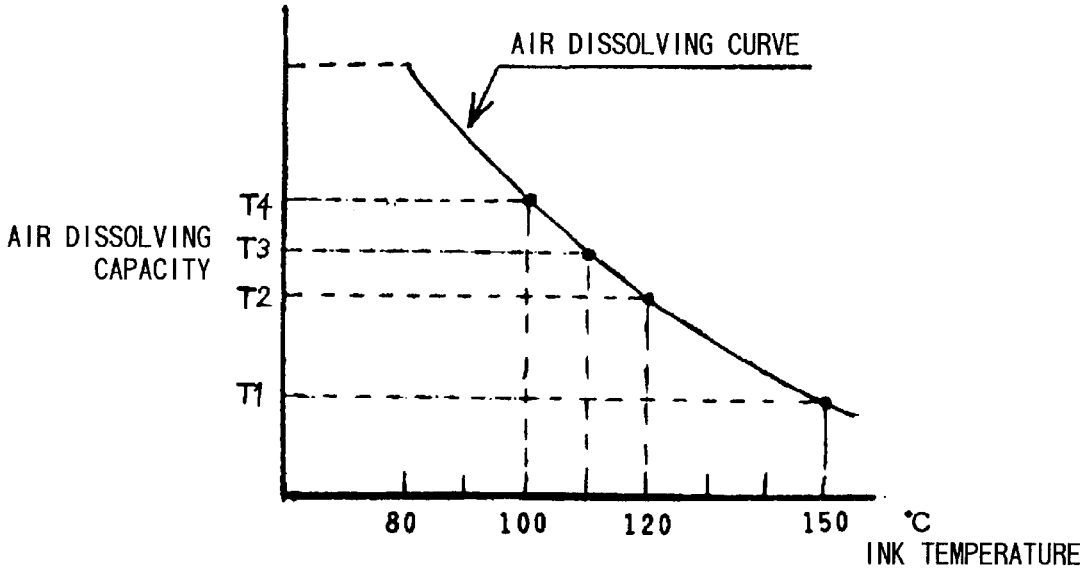
FIG. 3 is a graph showing the air dissolving capacity of ink according to changes in temperature.

Air can be dissolved in the hot melt ink I when the hot melt ink I is melted in a melted state. Air dissolving capacity of the hot melt ink I changes relative to temperature as shown in FIG. 3. It is noted that the air dissolving capacity of the hot melt ink I is defined as a ratio of the amount of air capable of being dissolved in the ink with respect to the total amount of the ink. In the graphs of FIGS. 3 and 4, T1, T2, T3, and T4 indicate the air dissolving capacity of the ink I at various temperature settings. It is noted that $T1<T2<T3<T4$.

As shown in FIG. 3, as the ink temperature rises, the air dissolving capacity of the hot melt ink I decreases. It is now assumed that the hot melt ink I, originally in a solid state, is heated at a temperature of 150° C. to be thermally melted into a liquid state. In this case, the thermally-melted ink I presents an air dissolving capacity of T1 shown in FIG. 3. The solid ink has originally been dissolved with almost no air. Accordingly, if the solid ink has been heated to the temperature of 150° C. in a condition contacted with air, the thermally-melted ink is dissolved with air at a ratio T1 of the dissolved air amount with respect to the total amount of ink.

It is further assumed that the hot melt ink I is subsequently cooled down to a temperature of 110° C. while not contacted with air. In this case, the air dissolving capacity of the ink rises to T3, which is than greater T1 as shown in FIG. 3. Because the ink is presently not contacted with air, the ink contains air still at the ratio T1 of the dissolved air amount with respect to the ink. In this case, the ink becomes capable of further containing dissolved air at an amount corresponding to the difference between the present air dissolving capacity T3 and the actually-contained dissolved air amount T1.

According to the present embodiment, air bubbles are eliminated from the ink by effectively using differential between the air dissolving capacity of the ink and the amount of air actually dissolved in the ink. That is, according to the present embodiment, the temperature of the ink supply chamber 1, the ink supply channel 2, the ink cooling path 6, the print head section 7, and the ink collecting chamber 9 are controlled as shown in FIG. 4.

More specifically, the ink supply chamber 1 and the ink collecting chamber 9 are heated by the heaters 41 and 44 to the temperature of 110° C. Thus, the hot melt ink I originally presents an air dissolving capacity T3. Because the ink I is stored in the chambers 1 and 9 in contact with air via the ink surface, the ink I contains dissolved air with the ratio T3 of the dissolved air amount with respect to the total ink amount.

The heater 3 is controlled to heat the ink supply channel 2 at the temperature of 150° C. As described already, ink in circulated from the ink supply chamber 1 through the manifold 30 and the ink collecting chamber 9 to the ink supply chamber 1 due to the ink level differential "h0" between the ink collecting chamber 9 and the ink supply chamber 1. With his arrangement, when stored in the ink supply chamber 1, ink is originally at the temperature of 110° C. and is dissolved with air at the ratio T3 of the dissolved air amount with respect to the ink amount. The ink then flows into the ink supply channel 2, where the ink is heated to the temperature of 150° C. At this time, the air dissolving capacity of the ink is decreased by the amount (T3−T1). As a result, ink is brought into an air supersaturated state. That is, the ink now presents the air dissolving capacity T1, which is smaller than the ratio T3 of the actually-dissolved air amount with respect to the ink amount. As a result, air bubbles are generated on the inner wall of the ink supply channel 2 at the upper position of the heater 3. The thus created air bubbles stick to the wall of the ink supply channel 2. Thus, some of the air originally dissolved in the ink I is separated from the ink I. The ink I therefore becomes containing a decreased amount of dissolved air. In other words, the ratio of the actually-dissolved air with respect to the ink amount decreases to T1.

It is note& that as the ink is repeatedly circulated through the manifold 30 and the ink tank 20, the air bubbles adhering to the wall of the ink supply channel 2 gradually gather, and move upwardly due to the buoyant force. The air bubbles are thus collected in the air bubble collecting chamber 5, which is located on the top of the ink supply channel 2. As will be described later, those air bubbles, thus collected in the air bubble collecting chamber 5 will be expelled from the air bubble release valve 4 when pressurized is introduced into the supply chamber 1 via the air through-hole 25 or the air is sucked via the air outlet 13.

During the circulation of ink in the ink jet printer 100, ink flows from the ink supply channel 2 to the ink cooling path 6. As shown in FIG. 2, the ink cooling path 6 is provided with the heat radiation fin 42. The excessively-heated ink I is cooled down to the temperature of 100° C. as shown in FIG. 4. This temperature of 100° C. is selected so that the hot melt ink I will not solidify into the solid state. Because the temperature of the ink I is thus decreased to 100° C., the air dissolving capacity is increased to T4, which is higher than the ratio T1 of the presently-dissolved air amount with respect to the ink amount. Accordingly, air can be easily dissolved in the ink. Air bubbles sticking to the walls in the cooling section 6 can therefore be dissolved into the ink. Even when air bubbles are trapped in depressions on the wall of the ink cooling path 6, the air bubbles can be properly dissolved in the ink.

The print head chamber 7 Is heated to 120° C. by the heater 43. When the ink I is supplied to the print head chamber 7 from the ink cooling path 6, the ink is heated to 120° C. Accordingly, the viscosity of the ink I becomes suitable for being ejected through the nozzles 36. More specifically, because the viscosity of the hot melt ink I at the temperature 100° C. is too large to be ejected, the temperature of the ink I is increased to 120° C. to decrease the viscosity. In the print head chamber 7, the nozzles 36 are selectively driven to eject ink I to a recording medium (not shown) positioned in confrontation with the nozzles 36.

Ink, not ejected through the nozzles 36, are then supplied through the ink collecting channel 8 to the ink collecting chamber 9. The ink is then supplied through the ink bypass path 12 back to the ink supply chamber 1.

While ink is repeatedly circulated through the ink tank 20 and the manifold 30 as described above, air bubbles are repeatedly released from the ink by the heater 3. Many of the air bubbles are collected in the air bubble collecting section 5. The air bubbles will be forcibly expelled through the air release valve 4 as will be described later. Residual air bubbles remained in the manifold 30 are dissolved back to the ink in the cooling section 6. Accordingly, through the repeated circulation of ink, the amount of air dissolved in the ink is gradually decreased, and the ratio of the amount of the actually-dissolved ink with respect to the ink amount gradually decreases to T1.

It is noted that in the print head chamber 7, the temperature of the ink I is adjusted to 120° C. Accordingly, the air dissolving capacity of the ink I becomes T2, which is higher than the ratio T1 of the actually-dissolved air amount with respect to the ink amount. Accordingly, air can be easily dissolved in the ink also in the print head section 7. Any air bubbles sticking to the walls in the print head chamber 7 can be dissolved in the ink I, making it possible to eliminate air bubbles from within the print head chamber 7. Even when air bubbles are trapped in depressions on the wall of the print head chamber 7, the air bubbles are properly dissolved in the ink. The print head chamber 7 will not suffer from any residual air bubbles remained in the print head chamber 7.

With the above-described structure, the ink jet printer 100 of the present embodiment operates as described below.

When a power source (not shown) of the heaters 3, 41, 43, and 44 is turned Off, temperature of the hot melt ink I drops, and the hot melt ink I condenses and solidifies accordingly. When the power source is again turned On, the ink I is melted back to a liquid state, and air bubbles are generated within the ink jet printer 100 in the same manner as in the conceivable printer. At this cold start timing, a purging process is performed. According to this purging process, a highly-pressurized air is introduced via the air hole 25 to the ink supply chamber 1 within a short period of time. As a result, ink is forced out through the air bubble release valve 4. More specifically, ink forcibly flows through the manifold 30, and pushes the ball 15 against the urging force of the compression spring 14. As a result, the ball 15 moves apart from the communication hole 35. Through the thus opened communication hole 35, ink flows into the additional chamber 34, and then flows out through the air outlet 13. Ink also flows out through the nozzles 36. Residual air is therefore expelled together with the ink through the openings 13 and 36. Thus, the residual air is removed from within the manifold 30 during the purging process.

After the purging process, the printing operation is performed. According to the present embodiment, the liquid state ink I is circulated through the ink tank 20 and the manifold 30 due to the maintained difference "h0" in the ink level between the ink supply chamber 1 and the ink collecting chamber 9. With the continuously-moving liquid ink I, air bubbles are removed from the print head section 7 and the ink cooling section 6. In the circulatory path of the ink, when the ink is supplied from the ink supply chamber 1 to the ink supply channel 2, the ink is overheated by the heater 3. The air dissolving capacity of the ink is decreased, and air bubbles are released from the ink. The air bubbles are collected in the air bubble collecting chamber 5. Accordingly, the amount of air dissolved in the ink is decreased. The ink then cooled at the ink cooling path 6 before the ink enters the print head section 7. The air dissolving capacity of the ink is increased. Accordingly, residual air bubbles, remained in the cooling path 6, are dissolved back to the ink. The above-described air bubble-releasing and -dissolving processes are repeatedly performed as the ink is circulated through the ink tank 20 and the manifold 30.

Accordingly, the amount of air actually dissolved in the ink is gradually decreased. Through the repeated circulation of the ink, the air dissolving capacity of the ink I becomes higher than the ratio of the actually-dissolved air amount with respect to the ink amount both in the ink cooling path 6 and in the print head chamber 7. Accordingly, residual air bubbles, even trapped in the depressions on the walls of the ink cooling path 6 and the print head chamber 7, can be removed through causing the bubbles to be dissolved back into the ink. Other air bubbles can be taken away from the ink cooling path 6 and the print head chamber 7 by the circulated ink flow. It therefore becomes possible to eliminate air bubbles in and around the print head section 7. Accordingly, the print head section 7 can perform a high quality printing operation through driving the nozzles 36.

Through the repeated circulation of the ink, air bubbles are repeatedly released from the ink by the heater 3 and are collected in the collecting portion 5. The air bubbles, collected in the collector 5, are then expelled via the release valve 4 through additional purging processes. The additional purging processes are repeatedly performed at a fixed time interval while the ink jet printer 100 is driven to be operated to perform its ink jet printing operation. The additional purging processes performed in the same manner as the purging process attained at the cold start timing.

According to the present embodiment, air bubbles can be separated from the ink through the temperature-controlled circulation of the ink as described above. Accordingly, the additional purging process may be performed less frequently than in the conceivable ink jet printer. For example, the additional purging process can be performed several times a day at a fixed time interval.

According to the present embodiment, even when some nozzles become incapable of jetting ink due to air bubbles generated therein, the air bubbles can be eliminated during the temperature-controlled circulation of the ink. No purging process is required to remove those air bubbles. Accordingly, it is possible to further reduce the number of the purging processes to be performed. The total amount of ink wasted during the purging processes can be greatly reduced.

According to the present embodiment, it is sufficient that air collected in the air collecting chamber 5 be expelled during the additional purging processes. Accordingly, the additional purging process can be operated in a manner described below. That is, a sucking device (not shown) is connected to the air outlet 13. The sucking device is controlled to suck air from the additional chamber 34 with a quite high air-sucking pressure within a quite short period of time so that the ball 15 will move away from the communication hole 35 and air will be sucked from the air bubble collecting chamber 5.

It is unnecessary that the ratio of the actually-dissolved air amount with respect to the ink amount decreases to T1 at the ink supply channel 2. In the ink supply channel 2, ink I is brought into the air super-saturated state according to the rapid increase in the temperature from 110° C. to 150° C. However, it takes a certain amount of time for the air super-saturated ink to release air bubbles. Accordingly, it is difficult for the ink to actually release air bubbles so that the ratio of the dissolved air amount with respect to the ink amount decreases to T1. It is sufficient that the ratio of the dissolved air amount with respect to the ink amount decreases to Tx in the ink supply channel 2 where the value Tx satisfies an inequality $T1<Tx<T3$. Because Tx satisfies an inequality $Tx<T4$, air bubbles can be sufficiently dissolved in the ink at the cooling section 6.

Through the repeated circulation of the ink I, air bubbles will be gradually removed further from the ink I at the ink supply path 2 and the ink cooling section 6. As a result, the ratio Tx of the dissolved air amount with respect to the ink amount will further decrease and will satisfy another inequality $T1<Tx<T2$. As a result, air bubbles can be dissolved in ink also at the print head chamber 7 because $Tx<T2$.

As described above, according to the ink jet printer of the present embodiment using hot melt ink, the heater 3 overheats ink in the ink supply channel 2. As a result, the air dissolving capacity of the ink is decreased. Air bubbles are released from the ink. The collector 5 collects the air bubbles. The air bubbles, collected in the collector 5, will be expelled from the release valve 4. The ink is then cooled before the ink enters the print head section 7. As a result, the air dissolving capacity of the ink is increased. Residual air bubbles, remained in the ink cooling path 6 and the print head section 7, are dissolved back to the ink. It is therefore possible to eliminate air bubbles in and around the print head section 7. The above-described air bubble-releasing and -dissolving processes are repeatedly performed as the ink is circulated through the ink tank 20 and the manifold 30 due to the maintained difference "h0" in the ink level between the ink supply chamber 1 and the ink collecting chamber 9.

While the invention has been described in detail with reference to the specific embodiment thereof, it would be apparent to those skilled in the art that various changes and modifications may be made therein without departing from the spirit of the invention.

For example, a piezoelectric vibration element 11 can be provided on the ink supply channel 2 as shown in FIG. 2. The piezoelectric vibration element 11 is supplied with a pulse-shaped voltage, thereby applying a pulse-shaped vibration to the ink supply channel 2.

In the ink supply channel 2, ink is brought into the air super-saturated state as described already. In this air super-saturated state, ink can release air bubbles more easily when the ink is applied with stimuli the form of vibrations or abrupt changes in its flow speed. More specifically, when the ink is supplied with vibrations or the like, air bubbles will be generated not only at the wall of the ink supply channel 2 but also from within the ink I located away from the channel wall. According to the present modification, therefore, the piezoelectric vibration element 11 is provided. When the piezoelectric vibration element 11 applies vibration to the ink supply channel 2, cavitation occurs in the ink, forcing generation of air bubbles. With this method, it is possible to promote release of air bubbles from the super-saturated ink, and therefore to increase the efficiency of eliminating air bubbles from the ink I in the ink tank through circulation of the ink.

As described above, according to the present invention, by controlling the temperature of the ink and the amount of air dissolved the ink through circulation of the ink, it is possible to eliminate air bubbles from the ink and to reduce the amount of ink wasted through the purging process.

What is claimed is:

1. An ink jet printing apparatus, the apparatus comprising:

an ink tank for collecting and storing hot melt ink;

a print head for selectively ejecting hot melt ink to a printing medium to thereby print images on the printing medium;

an ink circulatory path for supplying the print head with hot melt ink from the ink tank and for supplying the hot melt ink from the print head back to the ink tank, the ink circulatory path including:

an ink supply channel communicated between the ink tank and the print head and provided with a heater for heating ink in the ink supply channel, thereby causing air dissolved in the hot melt ink to be converted into air bubbles;

an air bubble collecting portion, provided to the ink supply channel, for collecting the air bubbles and for expelling air bubbles outside from the air bubble collecting portion:

an ink cooling channel, communicated between the ink supply channel and the print head, for cooling the hot melt ink, thereby causing residual air bubbles to be dissolved in the hot melt ink; and an ink collecting channel communicated between the print head and the ink tank to supply hot melt ink back to the ink tank.

2. An ink jet printing apparatus as claimed in claim 1, wherein the ink tank includes:

an ink supply chamber for supplying hot melt ink to the ink supply channel;

an ink collecting chamber for receiving hot melt ink from the ink collecting channel; and an ink bypass channel, communicated between the ink supply chamber and the ink collecting chamber, for supplying hot melt ink back to the ink supply chamber.

3. An ink jet printing apparatus as claimed in claim 2, wherein the ink bypass channel is provided with a pump for supplying hot melt ink from the ink collecting chamber to the ink supply chamber so as to maintain the ink level in the ink supply chamber to be higher than the ink level in the ink collecting chamber.

4. An ink jet printing apparatus as claimed in claim 1, further comprising excitation means for applying vibrations to the ink supply channel, thereby promoting generation of the air bubbles.

5. An ink jet printing apparatus as claimed in claim 1, wherein the air bubble collecting portion includes:

an air bubble collecting chamber provided on an upper portion of the ink supply channel; and an air bubble releasing valve for expelling the air bubbles collected in the air bubble collecting chamber.

6. A hot melt jet printing apparatus, the apparatus comprising:

an ink tank having an ink supply chamber and an ink collecting chamber for storing hot melt ink;

a print head for receiving hot melt ink and for selectively ejecting hot melt ink, thereby printing images;

an ink supply channel, provided between the ink supply chamber and the print head, for supplying the hot melt ink to the print head, the ink supply channel being provided with an overheating heater for overheating the hot melt ink, thereby releasing air bubbles from the hot melt ink, an air bubble collector for collecting the air bubbles and for expelling the air bubbles outside, and an ink cooling unit for cooling the overheated hot melt ink, thereby causing residual air bubbles to be dissolved in the hot melt ink;

an ink collecting channel, connected between the print head and the ink collecting chamber, for supplying hot melt ink not ejected from the print bead to the ink collecting chamber; and an ink bypass channel, connected between the ink supply chamber and the ink collecting chamber, the ink bypass channel being provided with a pump for supplying hot melt ink from the ink collecting chamber to the ink supply chamber to maintain that a level of hot ink in the ink supply chamber be higher than a level of hot melt ink in the ink collecting chamber, thereby achieving an ink circulatory flow through the ink supply chamber, the ink supply channel, the print head, the ink collecting channel, and the ink collecting chamber.

7. A hot melt ink jet printing apparatus as claimed in claim 6, further comprising an excitation unit for applying vibrations to the ink supply channel.

8. A hot melt ink jet printing apparatus as claimed in claim 6, wherein the overheating heater heats the hot melt ink, thereby decreasing air dissolving capacity of the hot melt ink and causing air bubbles to be released from the hot melt ink, the air bubble collector collecting the air bubbles, the ink cooling unit cooling the hot melt ink to a specified temperature at which the hot melt ink does not solidify, thereby increasing the air dissolving capacity of the hot melt ink and causing residual air bubbles to be dissolved in the hot melt ink, to eliminate air bubbles in and around the print head.

9. A method for removing air from ink in an ink jet printing apparatus, the method comprising the steps of:

thermally heating hot melt ink to cause air dissolved in the hot melt ink to be converted into air bubbles;

separating the air bubbles from hot melt ink;

thermally cooling the hot melt ink to cause residual air bubbles to be dissolved in the hot melt ink;

supplying the hot melt ink to a print head to selectively eject the hot melt ink; and supplying hot melt ink, not ejected from the print head, to the heating step, thereby repeatedly performing the heating step, the air bubble separating step, the cooling step, and the ink supplying step.

10. A method as claimed in claim 9, further comprising the step of forcibly ejecting the air bubbles separated from the hot melt ink outside of the ink jet printing apparatus.

11. A method as claimed in claim 9 wherein the air bubble separating step includes the step of applying vibration to the hot melt ink, thereby forcibly creating air bubbles from the hot melt ink.

12. A method of eliminating air bubbles from hot melt ink in an ink jet printing apparatus, the ink jet printing apparatus including an ink supply chamber, an ink supply channel connected to the ink supply chamber, an ink cooling channel connected to the ink supply channel, a print head connected to the ink cooling channel, an ink collecting channel connected to the print head, and an ink collecting chamber connected both to the ink collecting channel and the ink supply chamber, hot melt ink being circulating through the ink supply chamber, the ink supply channel, the ink cooling channel, the print head, the ink collecting channel, and the ink collecting chamber, the method comprising the steps of:

overheating hot melt ink in the ink supply channel, thereby reducing an air dissolving capacity of the hot melt ink and causing air bubbles from being released from the hot melt ink;

separating the air bubbles from the hot melt ink in the ink supply channel; and subsequently cooling the hot melt ink, in the ink cooling channel, to a specified temperature at which the hot melt ink does not solidify thereby increasing the air dissolving capacity of the hot melt ink and causing residual air bubbles to be dissolved in the hot melt ink, to eliminate air bubbles in and around the print head.

13. The method as claimed in claim 12, wherein the air bubbles are separated from the hot melt ink through collecting the air bubbles and expelling outside the collected air bubbles.

14. The method as claimed in claim 13, wherein release of the air bubbles from the hot melt ink with the decreased air dissolving capacity is promoted through applying vibration to the hot melt ink.

* * * * *